US005269889A

United States Patent [19]

McGregor

[11] Patent Number: 5,269,889

[45] Date of Patent: Dec. 14, 1993

[54] ELECTROLYTIC CLEANING AND REFURBISHING OF GRINDING WHEELS

[75] Inventor: Gavin McGregor, Gloucester, Canada

[73] Assignee: National Research Council of Canada/Conseil national de recherches Canada, Ottawa, Canada

[21] Appl. No.: 853,047

[22] Filed: Mar. 18, 1992

[30] Foreign Application Priority Data

Mar. 21, 1991 [CA] Canada ..... 2038753

[51] Int. Cl.[5] ..... C25F 1/00

[52] U.S. Cl. ..... 204/141.5; 204/275

[58] Field of Search ..... 204/141.5, 275

[56] References Cited

U.S. PATENT DOCUMENTS 4,236,985 12/1980 Grodzinsky ..... 204/129.46

4,849,599 7/1989 Kuromatsa ..... 204/129.46

*Primary Examiner*—T. M. Tufariello

*Attorney, Agent, or Firm*—Marks & Clerk

[57] ABSTRACT

In a method of grinding a workpiece employing a metallic grinding wheel supporting a non-conductive abrasive medium, a cathode is provided in spaced relationship with the abrasive surface so as to define a gap therewith. Electrolyte is caused to flow through the gap, and a low direct current is passed between the grinding wheel and the cathode through the electrolyte so that a small amount of metal is continually removed from the grinding wheel so that material trapped in the abrasive surface is dislodged and flushed away by the electrolyte flowing through the gap.

7 Claims, 1 Drawing Sheet

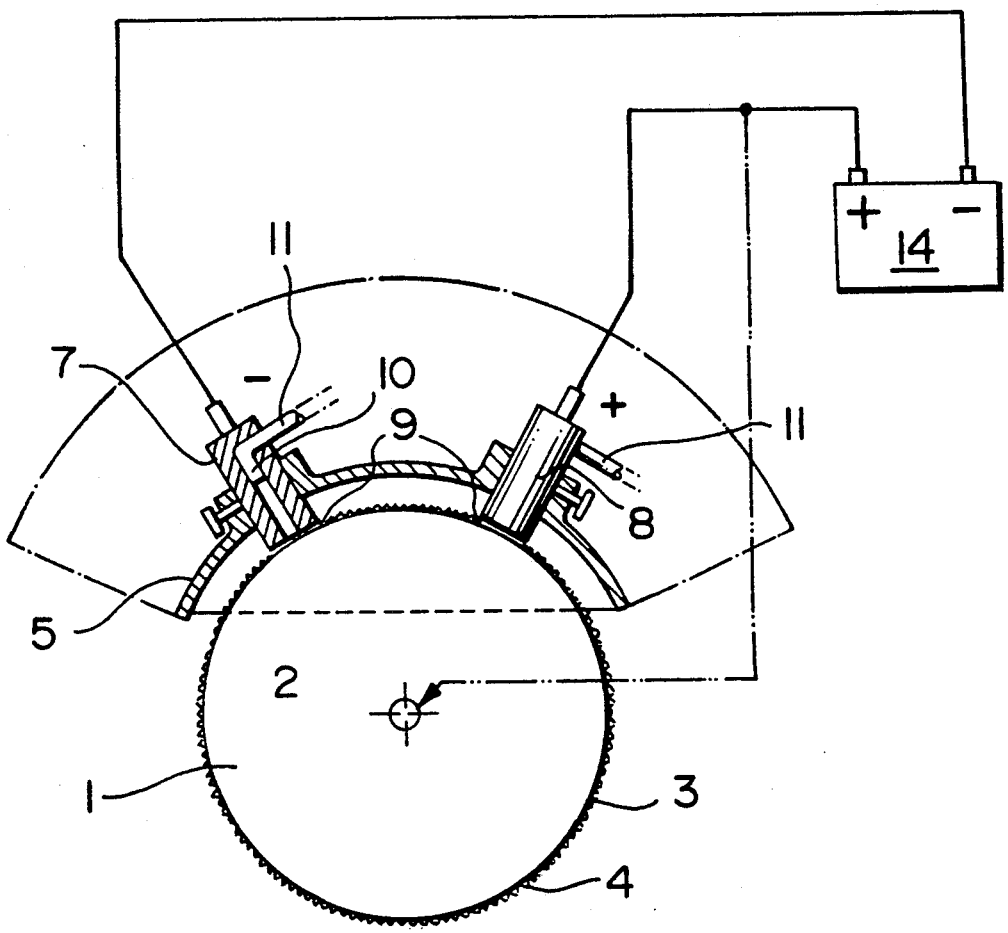
+
-
14
11
7
-
10
9
+
11
8
5
2
1
3
4

ELECTROLYTIC CLEANING AND REFURBISHING OF GRINDING WHEELS

BACKGROUND OF THE INVENTION

1. Field of the Invention

This invention relates to a method and apparatus for grinding workpieces with abrasive grinding wheels.

2. Description of the Prior Art

Abrasive grinding wheels are widely used in industry for finishing workpieces. Such wheels generally comprise a supporting wheel matrix with abrasive media, such as diamonds or other particulate abrasives, embedded in the metal substrate. The problem with such grinding wheels is that they become prematurely degraded as abraded material becomes trapped between the abrasive media on their surface. This problem is particularly pronounced with advanced materials, such as ceramics or composites. If such material is not removed, the efficiency of the grinding wheel will be adversely effected even though there may be plenty of life remaining in the abrasive media.

An object of the invention is to alleviate the aforementioned disadvantage.

SUMMARY OF THE INVENTION

According to the present invention there is provided a method of grinding a workpiece with a metallic grinding wheel having a metallic surface supporting a non-conductive abrasive medium, comprising providing a cathode in spaced relationship with the metallic surface so as to define a gap therewith, flowing electrolyte through said gap, and passing a low direct current between said grinding wheel and said cathode through said electrolyte so that a small amount of metal is continually removed from the grinding wheel and material trapped in the abrasive surface is thereby dislodged and flushed away by the electrolyte flowing through the gap.

The current passed through the grinding wheel is quite low, preferably less than 1 ampere. As a result very little metal is removed from the grinding wheel, but this is nonetheless sufficient to dislodge material trapped between the abrasive medium and the metallic surface of the wheel. This dislodged material is then flushed away by the electrolyte flowing through the gap.

The actual metal removal rate is approximately 0.0001 cubic inches per minute per amp.

If the material being machined is conductive, it is displaced from the wheel directly. However, the process is most useful for cleaning wheels that are used to grind non-conductive materials, such as ceramics and glass, which are notorious for their tendency to clog the wheel.

The invention also provides a grinding apparatus comprising a metallic grinding wheel having a metallic surface supporting a non-conductive abrasive medium, a cathode maintained in spaced relationship with the metallic surface to define a gap therewith, means for supplying a flow of electrolyte to said gap, and means for passing a low direct current between said grinding wheel and said cathode through said electrolyte to continually remove a small amount of metal from said grinding wheel and thereby dislodge material trapped in said abrasive surface so that it can be flushed away by said electrolyte.

The electrical circuit through the wheel can be completed either through a brush-type contact in contact with a spindle of the grinding wheel, or alternatively through an anode facing the grinding wheel and circumferentially spaced from the cathode. In the latter case, the electrolyte is arranged to flow both under the cathode and anode.

The grinding wheel can be made of metal. In the latter case, attrition of the surface occurs at a very low rate, but eventually the grinding wheel can be replated to replace lost metal. Alternatively, the grinding wheel can be of the resin bonded type. In the latter event the wheel is rendered metallic by flash coating with a thin metal coating, such as copper or silver, or simply by spraying it with a conductive paint prior to use.

The coating is applied over the whole wheel, including the abrasive medium, but the minimal wear resistance of the coating causes it to be rapidly removed from the abrasive media as soon as the wheel is put into operation.

BRIEF DESCRIPTION OF THE DRAWINGS

The invention will now be described in more detail, by way of example only, with reference to the accompanying drawing, in which the single figure is a diagrammatic view of a part of a grinding apparatus in accordance with the invention.

DESCRIPTION OF THE PREFERRED EMBODIMENTS

Referring to the figure, the grinding apparatus comprises a metal matrix grinding wheel 1 having a spindle 2 and a peripheral abrasive-bearing metallic surface 3, in which are embedded diamond particles 4. Diamond particles 4 can be replaced by other suitable abrasive media, such as cubic boron nitride particles and the like.

Above the wheel 1 is mounted a non-conductive cover plate 5, in which are located electrodes 7 and 8 terminating just above the abrasive surface 3 so as to define gaps 9 therewith. The electrodes 7, 8 are connected to a direct current power supply 14 capable of supplying an electric current of less than 1 amp. The electrode 7 is connected to the negative terminal of the power supply 14 and thus forms the cathode. Likewise the electrode 8 is connected to the positive terminal power source 14 and thus forms the anode.

The electrodes 7, 8 have an axial bore 10 communicating with an electrolyte inlet line 11 for supplying a flow of electrolyte through the gaps 9.

During operation of the grinding wheel, electrolyte flows through the electrode 7, 8 into the respective gaps 9. A low current, preferably less than one amp, is passed through the circuit completed by the power source 10, the electrode 7, 8, the grinding wheel 1, and the electrolyte flowing through the gaps 9. As a result of electrolytic action, metal is continually removed from the abrasive surface 3 of the grinding wheel 1. In the process, the removed metal dislodges abraded material trapped between the abrasive media 4. The dislodged material is then flushed away by the electrolyte flowing between the cathode 11 and abrasive surface 3. The electrolyte flowing between the anode 8 and abrasive surface 3 serves to complete the circuit.

In an alternative embodiment, the positive terminal of the power supply 10 is connected to the spindle 2 of the grinding wheel 1 by means of a brush-type contact 12 shown as a broken line connection in the figure. In this embodiment the anode 8 is unnecessary.

In the case of metal wheels, the metal matrix of the wheel can be allowed to become depleted to expose more abrasive and thus resharpen the wheel. After resharpening, the wheel can be plated or replated to preserve the basic metal matrix of the wheel.

Alternatively, the wheel can be of the resin bonded type with a metal coating. The coating can be formed by spraying the wheel with a conductive paint prior to use, or alternatively by flash coating the wheel with a thin metal coating, such as copper or silver. When the coating becomes too depleted, it can be replaced, and this process repeated until the abrasive media are no longer sharp. When the coating is first applied, it of course also become deposited on the abrasive media. However, the minimal wear resistance of the metal coating means that it becomes rapidly removed from the abrasive media as soon as the wheel is put into operation.

The material removal arrangement, including the cathode and electrolyte supply arrangement, can be made as an attachment for conventional grinding wheels.

The described apparatus not only prolongs the useful life of the grinding wheel, but also improves the quality of the abrasive operation, especially when cutting glass or composite materials.

I claim:

1. In a method of grinding a workpiece with a metallic grinding wheel having a metallic surface supporting a non-conductive abrasive medium, the improvement wherein a cathode is provided in radially spaced relationship with said metallic surface so as to define a gap therewith and circumferentially spaced relationship with said workpiece, electrolyte flows through a bore in said cathode into said gap, and a low direct current of less than one ampere is passed between said grinding wheel and said cathode through said electrolyte so that a small amount of metal is continually removed from the grinding wheel by electrochemical action, and said removed metal thereby dislodges material trapped in the abrasive surface, which is then flushed away by the electrolyte flowing through the gap.

2. A method of grinding a workpiece as claimed in claim 1, wherein the grinding wheel is a flash-metal coated non-conductive wheel, and said wheel is periodically reflash-metal coated to replace the removed metal.

3. A method of grinding a workpiece as claimed in claim 1, wherein the grinding wheel is made of metal, and said wheel is periodically replated to replace electrolytically removed metal.

4. A grinding apparatus, comprising a metallic grinding wheel having a metallic surface supporting a non-conductive abrasive medium, a cathode maintained in radially spaced relationship with the abrasive surface to define a gap therewith and having an axial bore therein, means for supplying a flow of electrolyte to said gap through said bore, and means for passing a low direct current of less than one ampere between said grinding wheel and said cathode through said electrolyte to continually remove a small amount of metal from said grinding wheel by electrochemical action and thereby dislodge material trapped in said abrasive surface so that it can be flushed away by said electrolyte flowing out of said bore.

5. A grinding apparatus as claimed in claim 4, wherein said cathode is mounted in a non-conductive cover plate extending over the grinding wheel.

6. A grinding apparatus as claimed in claim 4, further comprising an anode located proximate said abrasive surface and circumferentially spaced from said cathode for completing an electrical circuit through said grinding wheel.

7. A grinding apparatus as claimed in claim 4, further comprising a brush-type contact for establishing electrical connection with said grinding wheel.

* * * * *